US007161607B2

(12) United States Patent
Choi

(10) Patent No.: US 7,161,607 B2
(45) Date of Patent: Jan. 9, 2007

(54) METHOD OF DRIVING PLASMA DISPLAY PANEL AND APPARATUS THEREOF

(75) Inventor: Jeong Pil Choi, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 486 days.

(21) Appl. No.: 10/388,394

(22) Filed: Mar. 17, 2003

(65) Prior Publication Data

US 2003/0174103 A1 Sep. 18, 2003

(30) Foreign Application Priority Data

Mar. 18, 2002 (KR) ..... 10-2002-0014502

(51) Int. Cl.
*G09G 5/10* (2006.01)

(52) U.S. Cl. ..... 345/690; 345/63

(58) Field of Classification Search ..... 345/690, 345/60, 63

See application file for complete search history.

(56) References Cited

U.S. PATENT DOCUMENTS 5,757,343 A * 5/1998 Nagakubo ..... 345/63
6,388,678 B1 * 5/2002 Kasahara et al. ..... 345/690
2002/0175922 A1 * 11/2002 Koo et al. ..... 345/589
2003/0169217 A1 * 9/2003 Kang et al. ..... 345/63

FOREIGN PATENT DOCUMENTS

| | | |
|---|---|---|
| JP | 01-163794 | 6/1989 |
| JP | 03-238497 | 10/1991 |
| JP | 08-305321 | 11/1996 |
| JP | 10-207426 | 8/1998 |
| JP | 11-052913 | 2/1999 |
| JP | 11-231833 | 8/1999 |
| JP | 2001-067042 | 3/2001 |
| JP | 2001-075522 | 3/2001 |
| JP | 2001-255843 | 9/2001 |
| JP | 2001-343925 | 12/2001 |
| JP | 2002-006794 | 1/2002 |
| JP | 2002-023693 | 1/2002 |
| JP | 2002-354378 | 12/2002 |

* cited by examiner

*Primary Examiner*—Kent Chang
(74) *Attorney, Agent, or Firm*—Fleshner & Kim, LLP

(57) ABSTRACT

Disclosed is a method of driving a plasma display panel and an apparatus thereof enabling to manage digital signal for driving a plasma display panel. The apparatus for driving a plasma display panel has a PDP driving unit which supplies the plasma display panel with the video signal outputted from a scan converter after revision and controls the sustain discharge period of sub-field to adjust contrast and brightness of a picture.

12 Claims, 6 Drawing Sheets

METHOD OF DRIVING PLASMA DISPLAY PANEL AND APPARATUS THEREOF

This application claims the benefit of the Korean Application No. P2002-14502 filed on Mar. 18, 2002, which is hereby incorporated by reference.

BACKGROUND OF THE INVENTION

1. Field of the Invention

The present invention relates to a plasma display panel, and more particularly, to a method of driving a plasma display panel, and an apparatus thereof enabling to manage a digital signal properly.

2. Background of the Related Art

Generally, a plasma display panel (hereinafter abbreviated PDP) is a display device that displays a picture by effecting luminescence of phosphors by ultraviolet (UV) rays generated from the discharge of a gas. Such a PDP has the advantage that it can be easily formed into a thin film and large-sized, and, compared to the conventional Cathode Ray Tube: (CRT), it can provide a greatly improved picture quality.

As shown in FIG. 1, a discharge cell of PDP includes scan and sustain electrodes 30Y and a common sustain electrode 30Z formed in parallel with each other under a front substrate 10 and an address electrode formed on a back substrate 18. In this case, each scan and sustain electrodes 30Y and the common sustain electrode 30Z are composed of transparent electrodes 12Y, 12Z and metal bus electrodes 13Y, 13Z which are narrower than the transparent electrodes 12Y, 12Z. This transparent electrodes 12Y, 12Z are formed with Indium-Tin-Oxide (ITO), and the metal bus electrodes 13Y, 13Z are formed with Cr to reduce a drop of electric pressure by the highly resistant transparent electrodes 12Y, 12Z.

Also, on the front substrate 10 are laminated a front dielectric layer 14 and a protective layer 16. On the front dielectric layer 14 is accumulated wall charge generated during plasma discharge. The protective layer 16 prevents the front dielectric layer 14 from being damaged by the plasma discharge, and heightens the emission efficiency of secondary electrons. A magnesium oxide (MgO) is typically used for the protective layer 16.

A back dielectric layer 22 and barrier ribs 24 are formed on the back substrate 18, where an address electrode 20X is formed, and a phosphor 26 is coated on the surfaces of the address electron 20X and the barrier ribs 24. The address electrode 20X is formed in an intersectional direction of the scan and sustain electrode 30Y and the common sustain electrode 30Z. The barrier ribs 24 are formed in parallel with the address electrode 20X to prevent ultraviolet and visible rays from leaking in an adjacent discharge cell. The phosphors 26 become excited by the ultraviolet rays generated from plasma discharge so as to irradiate one of red, green, and blue visible rays.

Such a PDP divides a single frame into many sub-fields in order to display a gray scale of a picture. And, each sub-field is divided into a reset period to generate electric discharge equally, an address period to choose a discharge cell, and a sustain period to enable to change the gray scale of the picture according to the frequency of electric discharge.

During the address period, scan pulses are applied to the scan and sustain electrodes 30Y and data pulses synchronized with the scan pulse is applied to the address electrode 20X. At this time, an address discharge is generated from discharge cells to which the scan and data pulses are applied. And, after scan pulses are applied to both of the scan and sustain electrodes 30Y, a sustain pulse is applied to scan and sustain electrodes 30Y and the common sustain electrode 30Z alternately. After that, a sustain discharge is generated in discharge cells from which the address discharge has been generated.

In case that a picture is displayed with 256 gray scales, a frame duration (16.67 ms) corresponding to 1/60 second is separated into eight sub-fields. The reset and address periods of each sub-field are the same in each sub-field, and, on the contrary, the sustain period increases in the ratio of $2^n$ (n=0, 1, 2, 3, 4, 5, 6, 7, 8.) Thus, sustain periods in each sub-field changes so as to realize the gray scale of a picture.

FIG. 2 illustrates the apparatus for driving a plasma display panel. As shown in FIG. 2, the apparatus for driving a plasma display panel is composed of a video signal unit 32, a video scan converter (VSC) 34 and a PDP driving unit 36.

The video signal unit 32 inputs an analog signal included a video signal and adjusts the level of voltage and gains so as to control brightness and contrast of a picture according to the control of a user.

The video scan converter 34 converges an analog signal inputted from the video signal unit 32 according to the resolution of PDP. At this time, the analog signal is changed to digital signal and is inputted into the driving unit 36.

And, the PDP driving unit 36 revises the digital signal inputted from the video scan converter 34, and supplies the PDP with the revised digital signal.

The conventional PDP driving device can only display images corresponding to analog signal but can't display images corresponding to the digital signal. Even if a digital and an analog converter is equipped to display images corresponding to digital signal the resolution of PDP is deteriorated by perversion and reduction generated in the transformation process of digital to analog to digital signal.

SUMMARY OF THE INVENTION

The object of the present invention is to provide a method of driving a plasma display panel and an apparatus thereof enabling to manage a digital signal properly.

To achieve this object and in accordance with the purpose of the invention, as embodied and broadly described herein, the apparatus for driving a plasma display panel includes a video scan converter converting the input video signal in accordance with the resolution of the panel, a PDP driving unit supplying panel with the revised video signal outputted from the scan converter and controlling the sustain discharge period of sub-field to adjust the contrast and brightness of a picture.

The PDP driving unit comprises the first and second inverse-gamma correction units performing the inverse-gamma correction of the video signal outputted from the video scan converter respectively, a gain control unit amplifying the outputted signal from the inverse-gamma correction unit in accordance with the established effective gains, an error diffusion unit calculating the error element of discharge cell from the output signal of the gain control unit and diffusing the error element to adjacent cells, an APL unit controlling the frequency of pulses according to the output signal from the error diffusion unit, the contrast control unit receiving output signal from the video scan converter and controlling the sustain discharge period so as to control the contrast of a picture, the brightness control unit receiving the output signal from the video scan converter and controlling the sustain discharge period so as to control brightness of a picture. And, the contrast control unit controls the sustain discharge period of one or more sub-fields and the brightness control unit controls the sustain discharge period of all sub-fields in the same ratio.

In another aspect of the present invention, included are a video scan converter converting digital signal inputted from outside according to the resolution of the panel and the PDP driving unit diffusing the error element of discharge cell and controlling the sustain discharge period of sub-field so as to adjust brightness of a picture.

In this case, the PDP driving unit has the error diffusion unit calculating and diffusing the error element to adjacent cells and the brightness control unit controlling the sustain discharge period of sub-field responding to the control signal of user.

And, the error diffusion unit calculates the error diffusion element by dividing the digital signal by integer and prime values and multiplying the coefficient of floy-steinberg to the prime value.

In another form of the present invention, an apparatus for driving a plasma display panel includes an error diffusion unit calculating and diffusing the error element of discharge cell from video signal to adjacent cells, an APL unit controlling the number of pulses supplied to panel in accordance with the average luminosity of the video signal, a contrast control unit receiving the video signal and controlling the sustain discharge period to control contrast of a picture according to the control of user, a brightness control unit receiving the video signal and controlling the sustain discharge period to control brightness of a picture according to the control of user.

The method of driving a plasma display panel, according to the present invention, in a way of inputting digital signal from outside and dividing the signal into a number of sub-fields, comprises steps of; (a) A first step of converting the digital signal inputted from outside according to the resolution of the panel, and (b) A second step of controlling the sustain discharge period so as to control brightness and contrast of a picture.

In the step of controlling contrast and brightness of a picture, the sustain discharge period of all sub-fields are increased or decreased in the same ratio to control brightness of a picture, and the sustain discharge period of at least one or more sub-fields are increased or decreased in the same ratio to control contrast of a picture.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Hereinafter, the device and method for driving a Plasma Display Panel according to the preferred embodiments of the present invention will be explained with the plans for reference.

Figure 1:
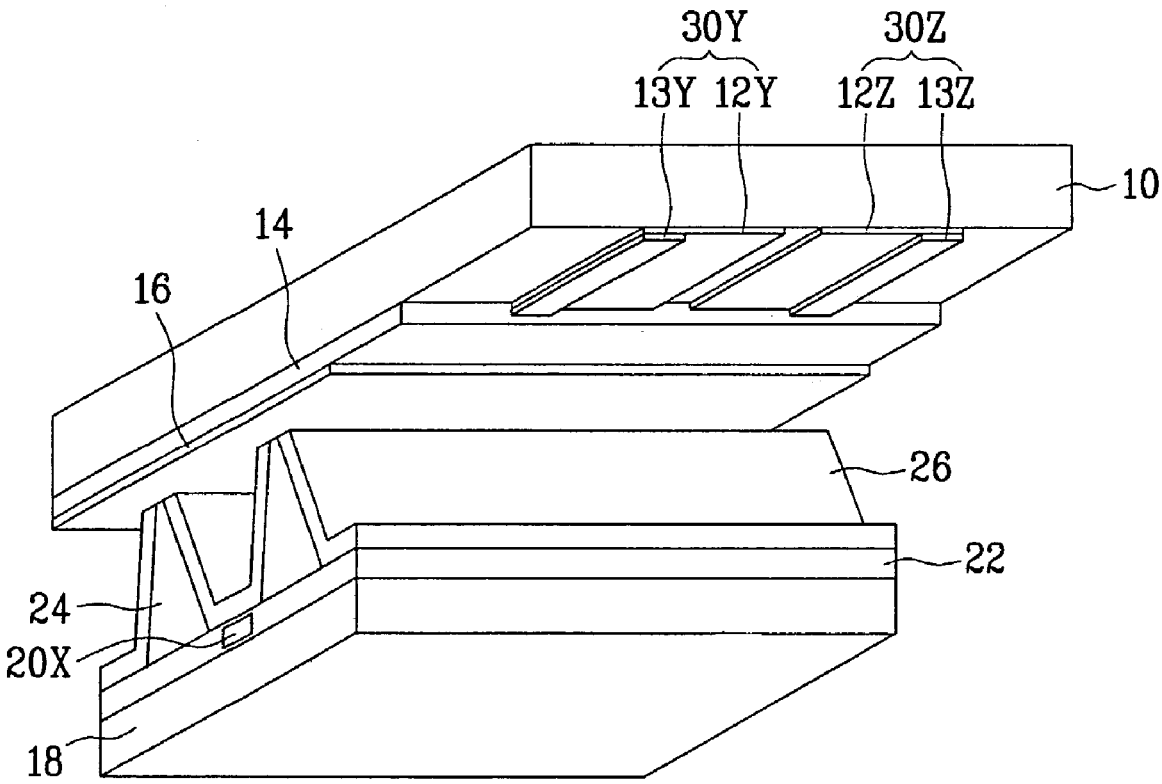
FIG.1 Related Art
FIG. 1 illustrates a perspective view of a discharge cell of former Plasma Display Panel.
Figure 2:
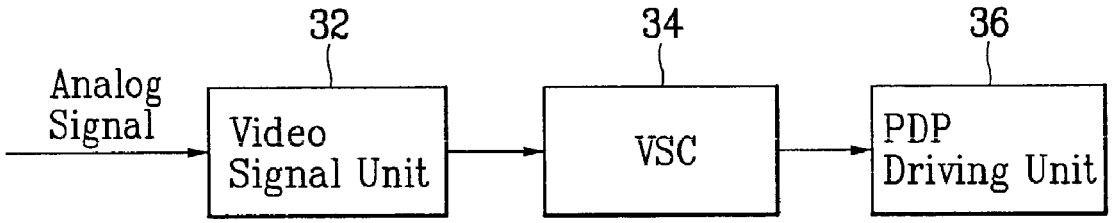
FIG.2 Related Art
FIG. 2 illustrates a block view of driving device of Plasma Display Panel.
Figure 3:
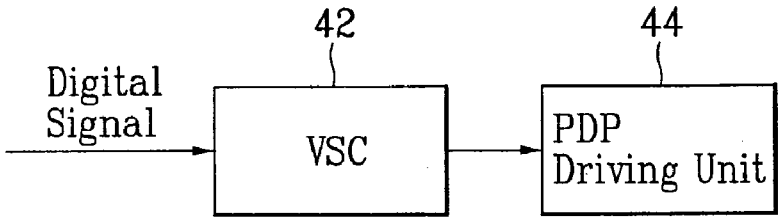
FIG. 3 illustrates a block view of diving device of Plasma Display Panel according to the present invention.
Figure 4:
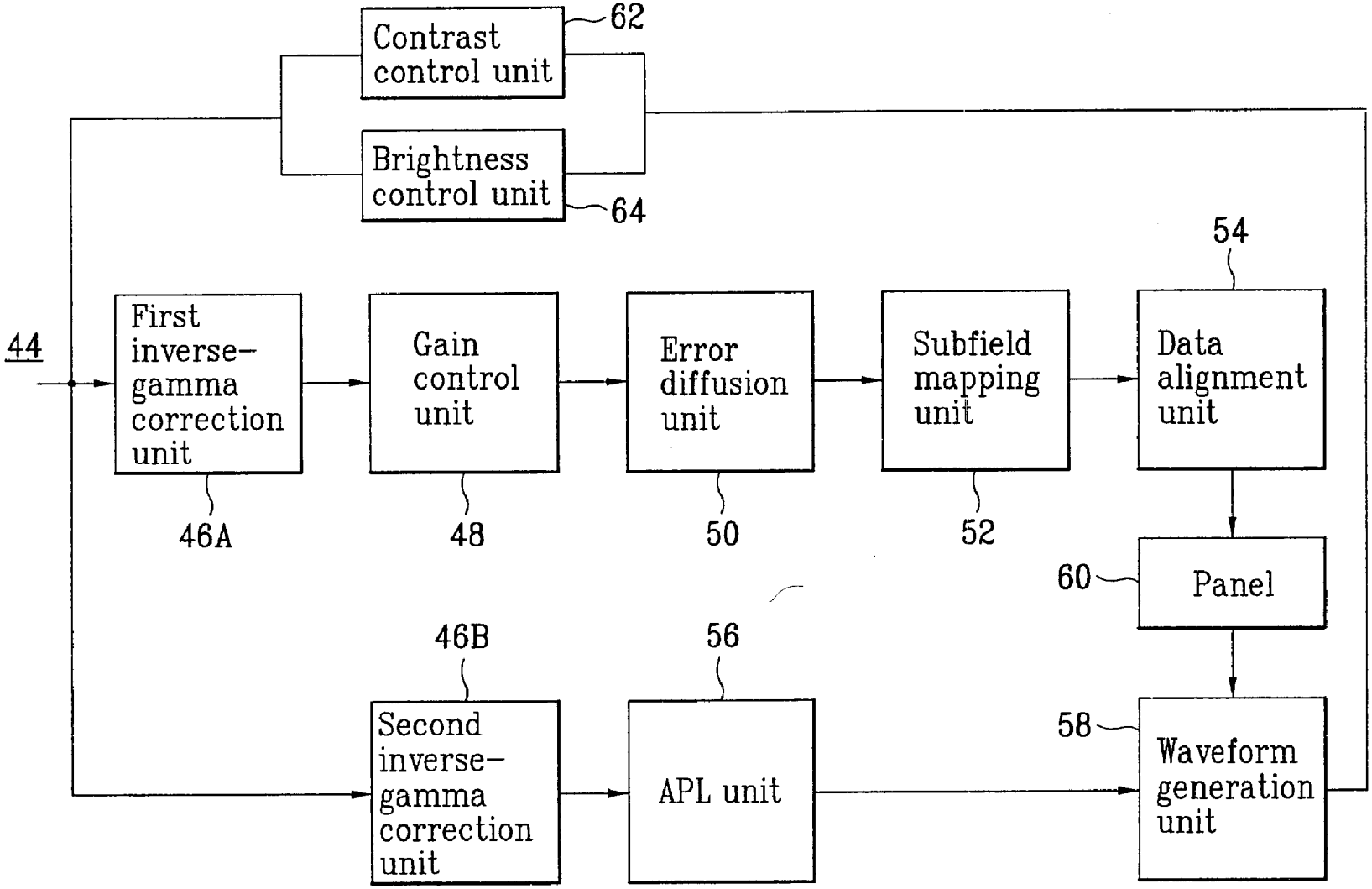
FIG. 4 illustrates a block view of PDP driving unit in FIG. 3.

FIG. 3 illustrates a plan of a PDP driving device in accordance with the embodiment of the present invention.

As shown in FIG. 3, the driving device for PDP has a video scan converter (VSC) 42 and a PDP driving unit 44 in accordance with the embodiment of the present invention.

A video scan converter (VSC) 42 inputs adigital signal (that is, video data) from outside and converts the data corresponding to the resolution and sends the converted digital signal to the PDP driving unit 44.

The PDP driving unit 44 revising the digital signal has the first inverse-gamma correction unit 46A, a gain control unit 48, an error diffusion unit 50, a sub-field mapping unit 52, a data alignment unit 54, the second inverse-gamma unit 46B, an APL (Average Picture Level) unit 56, a waveform generation unit 58, a panel 60, a contrast control unit 62, and a brightness control unit 64.

The first and second inverse-gamma correction units 46A and 46B perform the gamma correction of the video signal (digital signal) outputted from a VSC 42 and change the value of brightness according to the gray scale of video signal in lineal form.

The gain control unit 48 amplifies the video signal corrected in the first inverse-gamma correction unit 46A according to effective gains. An APL unit 56 inputs the video signal corrected by the second inverse-gamma correction unit 46B, and produces signals segmented in multiple stages to adjust the frequency of sustain pulses.

The error diffusion unit 50 inputs the outputted signal from the gain control unit 48, and controls the value of brightness in full detail by diffusing the error element of discharge cell to the adjacent cells. And, the sub-field mapping unit 52 inputs video signal corrected by the error diffusion unit 50 and distributes the corrected video signal to each sub-fields.

The data alignment unit 54 inputs the video signal from the sub-field mapping unit 52, aligns the video signal, and then supplies the video signal to the address driving integrated circuit (not illustrated).

The waveform generation unit 58 generates a timing control signal by N-stage signal outputted from the APL unit 56, and supplies the timing control signal to an address driving IC, a scan driving IC and a sustain driving IC of the panel 60.

The contrast control unit 62 and brightness control unit 64 receive digitalized video signal from the VSC 42 and adjust contrast and brightness of the picture by controlling the sustain period of the plasma display panel (discharge cells).

The following is the detailed explanation related to the movement of the PDP driving device. First, the second inverse-gamma correction unit 46B receives the digital signal from the VSC 42. The digital signal, the video signal performed gamma correction by the second inverse-gamma correction unit 46B, is supplied to the APL unit 56.

And, after inputting the inverse-gamma corrected video signal, the APL unit 56 selectively supplies one of the fixed signals, segmented in many stages according to the average luminosity of video signal, to the waveform generation unit 58 to adjust the number of sustain pulses. That is, it selects the number of the sustain pulses, fixed according to the average luminosity of the video signal, and supplies it to the waveform generation unit 58. The APL unit 56 decreases all the number of sustain pulse when the average luminosity of the video signal is so bright, or increases all the frequency of sustain pulse when the average luminosity of the video signal is so dark.

The first inverse-gamma correction unit 46A revises the gamma corrected signal to inverse the gamma corrected signal and supplies the gain control 48 with the revised signal. The gain control 48 inputs and amplifies the inverse-gamma corrected signal according to the established effective gains and supplies the signal to the error diffusion unit 50.

And, the error diffusion unit 50 separates the video signal into the integer and prime numbers to calculate the error element, multiples Floy-steinberg coefficient to the prime number, and controls the value of brightness in full detail by diffusing the error element to the adjacent cell.

Continuously, the video signal outputted from the error diffusion unit 50 is inputted to the sub-field mapping unit 52. The sub-field mapping unit 52 supplies the data alignment unit 54 with the video signal outputted from the error diffusion unit 50 after mapping the video signal in each sub-fields according to the value of gray scale.

The brightness control unit 64 adjusts brightness of a picture according to the control signal inputted from a user's remote control or a control panel. Such brightness control unit 64 controls the brightness of a picture displayed on the panel 60 by controlling sustain periods in a lump.

Figure 5:
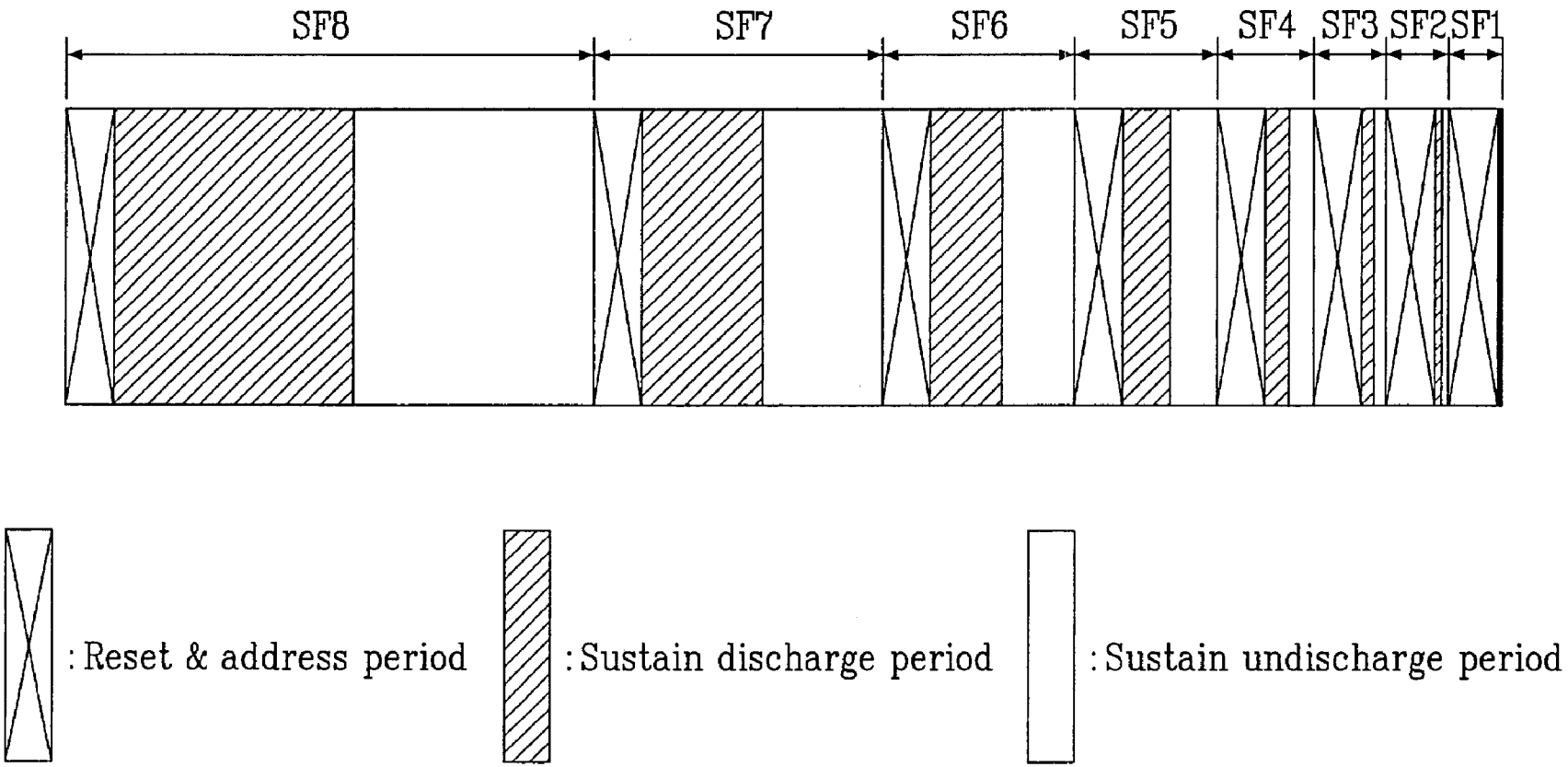
FIG. 5 illustrates a view of frame in the case that the brightness control unit sets sustain discharge period to half of each sustain period.

This brightness control unit 64 controls the period of discharge in the sustain periods in response to the control signal inputted from a user's remote control. As an example, in FIG. 5, the sustain discharge is generated for half of each sustain discharge period and is not generated for the rest of time. Brightness of a picture is set to the 50% of the normal electric discharge if the electric discharge is generated for half of all the sustain period.

In other words, the brightness control unit 64 of the present invention controls brightness of the picture displayed on the panel 60 by regulating all the sustain discharge period of sub-field in batch processing.

Figure 6:
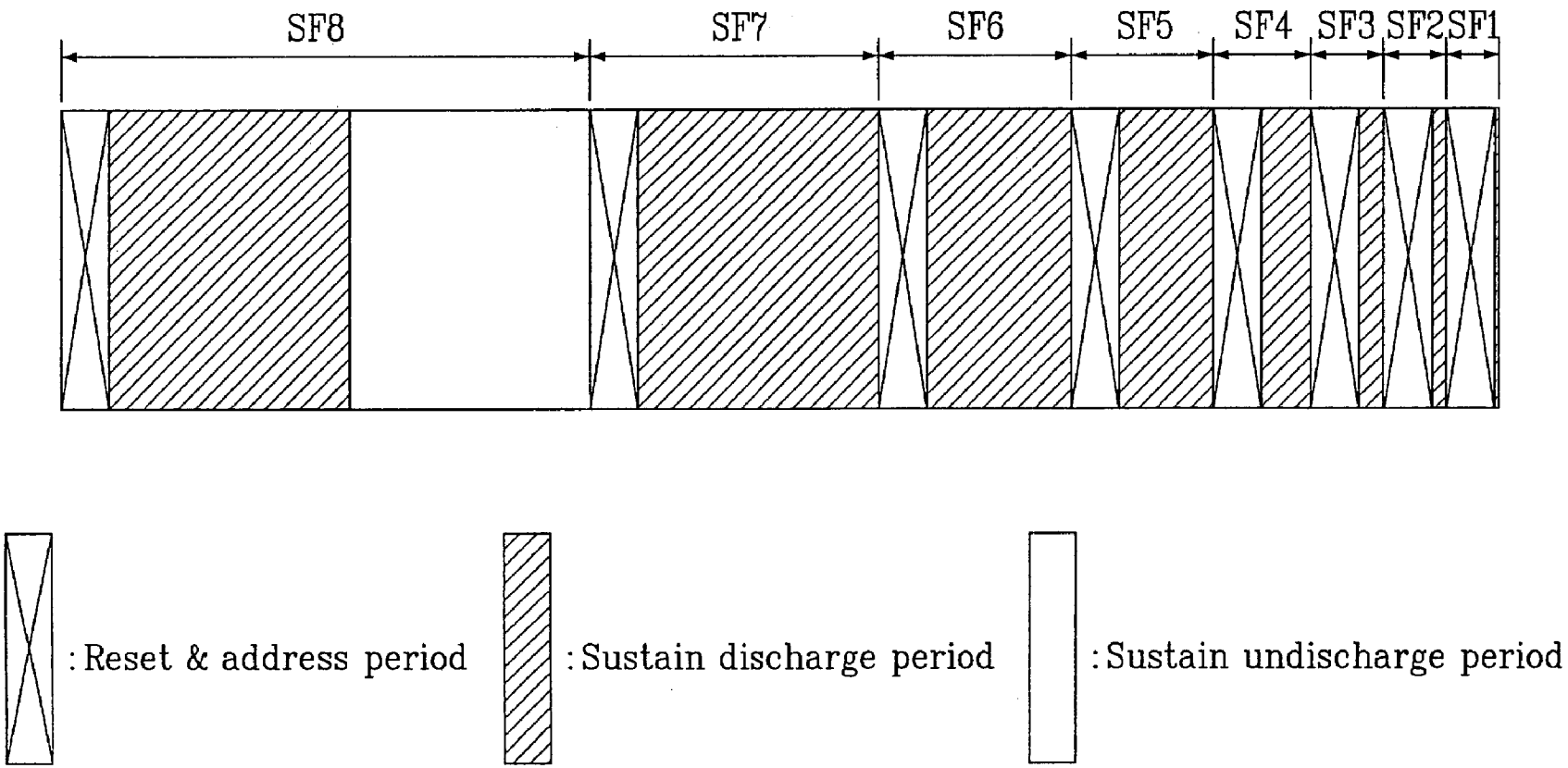
FIG. 6 illustrates a view of frame in the case that the contrast control unit sets sustain discharge period to half of sustain period in the 8th sub-field (SF8)

Also a contrast control unit 62 controls the contrast of a picture displayed on the panel 60 according to the control signal inputted from a user's remote control or a control panel. As in FIG. 6, the contrast of a picture is controlled by controlling the sustain discharge period of at least one or more sub-fields. As an example, in FIG. 6, the sustain discharge period of the eighth sub-field (SF8) is set to 50%. In this manner, if the sustain discharge period of the eighth sub-field (SF8) is decreased the contrast ratio of the picture displayed on panel 60 is adjusted to low.

Figure 7:
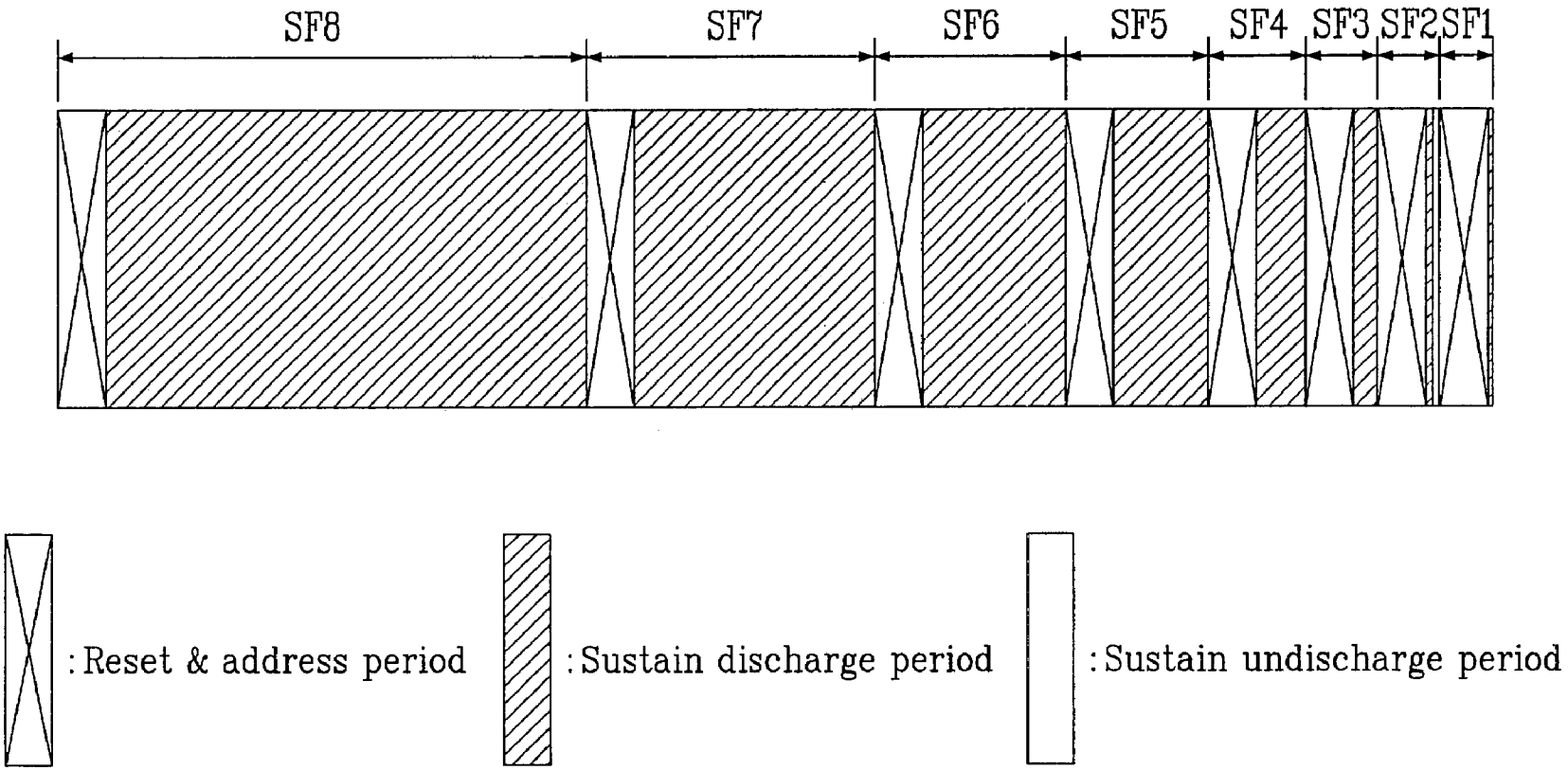
FIG. 7 illustrates a view of frame in the case that the contrast controll unit, in FIG. 4, sets sustain discharge period to half of sustain period in the first and second sub-field (SF1, SF2)

In the same manner, as in FIG. 7, the contrast control unit 62 can set the sustain discharge periods of the first and second sub-field (SF1, SF2) to about 50%. On this wise, if the sustain discharge periods of the first and second sub-fields SF1, SF2 is reduced the contrast ratio of the picture displayed on the panel 60 will be adjusted to high. That is, the contrast control unit 62 controls the sustain period of at least one or more sub-fields so as to control the contrast of the picture displayed on panel 60.

And, the waveform generation unit 58 connected to the contrast control unit 62 and the brightness control unit 64 generates a timing control signal using the N-stage signal outputted from the APL unit 56, supplies the address driving IC, the scan driving IC and the sustain driving IC with the timing control signal. That is, the waveform generation unit 58 is controlled by the contrast control unit 62 and the brightness control unit 64, and generates the timing control signal to control the frequency of discharge in the sustain period included in each sub-field.

As mentioned above, the device and method for driving PDP according to the present invention, a picture can be displayed without having the process of converting from digital to analog signal even though the digital signal is inputted from outside. Hence, the distortion and the reduction of signal in the process of converting can be prevented. In addition, according to the present invention, the brightness and contrast control units are installed in the PDP driving device so as to control brightness and contrast of the picture displayed on the panel.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for driving a plasma display panel (PDP) comprising:

a video scan converter converting an input video signal in accordance with a resolution of the plasma display panel; and a PDP driving unit correcting a video signal outputted from the scan converter, supplying the plasma display panel with the corrected video signal, and controlling a sustain discharge period of a sub-field so as to adjust contrast and brightness of a picture according to a control signal inputted from a user's remote control or control panel.

2. The apparatus of claim 1, wherein the PDP driving unit comprises:

first and second inverse-gamma correction units respectively performing inverse-gamma correction of the video signal outputted from the video scan converter;

a gain control unit amplifying an output signal from the first inverse-gamma correction unit according to a prescribed effective gain;

an error diffusion unit calculating an error element of a discharge cell from an output signal of the gain control unit and diffusing the error element to adjacent cells;

an average picture level unit controlling a number of sustain pulses according to an output signal from the error diffusion unit;

a contrast control unit receiving the output signal from the video scan converter and controlling the sustain discharge period so as to adjust a contrast of the picture; and a brightness control unit receiving the output signal from the video scan converter and controlling the sustain discharge period so as to adjust brightness of the picture.

3. The apparatus of claim 2, wherein the PDP driving unit controls the sustain discharge period of one or more sub-fields.

4. The apparatus of claim 2, wherein the PDP driving unit controls the sustain discharge periods of all sub-fields with a same ratio.

5. An apparatus for driving a plasma display panel (PDP), comprising:

a video scan converter converting an input digital signal according to a resolution of the plasma display panel; and a PDP driving unit controlling a sustain discharge period of a sub-field and diffusing an error element of a discharge cell to adjacent cells so as to control brightness of a picture, wherein the PDP driving unit includes:

an error diffusion unit calculating the error element of the discharge cell from the digital signal and diffusing the error element to the adjacent cells, and a brightness control unit controlling sustain discharge periods of all sub-fields with a same ratio in response to a user's control signal.

6. The apparatus of claim 5, wherein the error diffusion unit divides the digital signal into integer and prime number values, and multiplies the floy-steinberg coefficient to the prime value.

7. The apparatus of claim 5, wherein the PDP driving unit further includes a contrast control unit controlling the sustain discharge period of one or more sub-fields to control the contrast of the picture according to the control signal inputted from a user's remote control or control panel.

8. The apparatus of claim 1, wherein the PDP driving unit increases or decreases the sustain discharge period of the sub-field according to the control signal inputted from the user's remote control or control panel.

9. A method of driving a plasma display panel receiving an input digital signal and dividing into many sub-fields, comprising:

(a) converting an input digital signal according to a resolution of the plasma display panel; and (b) controlling brightness and contrast of a picture displayed on the plasma display panel by adjusting a sustain discharge period of a sub-field in response to a control signal inputted from a user's remote control.

10. The method of claim 9, wherein the sustain discharge periods of all sub-fields are either increased or decreased with a same ratio to adjust the brightness of the picture.

11. The method of claim 9, wherein the sustain discharge period of at least one sub-field is either decreased or increased to adjust the contrast of the picture.

12. The method of claim 9, wherein the sustain discharge period of at least one sub-field is either decreased or increased to adjust the brightness of the picture.

* * * * *